US009254695B2

(12) United States Patent
Nishikawa

(10) Patent No.: US 9,254,695 B2
(45) Date of Patent: Feb. 9, 2016

(54) PRINTING APPARATUS FOR PRINTING AN IMAGE ON A PRINTING MEDIUM AND CONVEYANCE CONTROL METHOD THEREFOR

(71) Applicant: CANON KABUSHIKI KAISHA, Tokyo (JP)

(72) Inventor: Yukinori Nishikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/226,351

(22) Filed: Mar. 26, 2014

(65) Prior Publication Data

US 2014/0300659 A1 Oct. 9, 2014

(30) Foreign Application Priority Data

Apr. 4, 2013 (JP) ..... 2013-078983

(51) Int. Cl.
*B41J 29/38* (2006.01)
*B41J 11/42* (2006.01)

(52) U.S. Cl.
CPC ..... *B41J 11/42* (2013.01)

(58) Field of Classification Search
CPC ..... B41J 11/42
USPC ..... 347/16, 143; 702/189; 399/44; 318/600
See application file for complete search history.

(56) References Cited

U.S. PATENT DOCUMENTS

| | | | | |
|---|---|---|---|---|
| 5,706,219 | A | 1/1998 | Ishimoto | |
| 5,719,789 | A * | 2/1998 | Kawamata | 702/189 |
| 2003/0072578 | A1 * | 4/2003 | Boothe et al. | 399/44 |
| 2007/0007925 | A1 * | 1/2007 | Yamane | 318/600 |
| 2015/0091745 | A1 * | 4/2015 | Pagnanelli | 341/143 |

FOREIGN PATENT DOCUMENTS

JP 8-201111 A 8/1996

* cited by examiner

*Primary Examiner* — Julian Huffman
*Assistant Examiner* — Carlos A Martinez
(74) *Attorney, Agent, or Firm* — Fitzpatrick, Cella, Harper & Scinto

(57) ABSTRACT

An apparatus is provided. The apparatus comprises: an acquiring unit configured to acquire data generated at a predetermined period in accordance with driving of a conveyance unit configured to convey a printing medium; a first specify unit configured to specify an average value of the data based on a plurality of data acquired by the acquiring unit; a second specify unit configured to specify a conveyance velocity of the printing medium based on the average value of the data specified by the specify unit; a deciding unit configured to decide a number of data, used by the second specify unit, for specifying the average value of the data in accordance with the conveyance velocity specified by the second specify unit; and a control unit configured to control the conveyance unit using the average value of the data specified by the second specify unit as position data of the printing medium.

15 Claims, 8 Drawing Sheets

PRINTING APPARATUS FOR PRINTING AN IMAGE ON A PRINTING MEDIUM AND CONVEYANCE CONTROL METHOD THEREFOR

BACKGROUND OF THE INVENTION

1. Field of the Invention

The present invention relates to a printing apparatus for printing an image on a printing medium such as a printing paper sheet and a printing medium conveyance control method of the apparatus and, particularly to, for example, a printing apparatus for performing color printing based on an inkjet method and a printing medium conveyance control method.

2. Description of the Related Art

Inkjet printing apparatuses (to be referred to as printing apparatuses hereinafter) have proliferated in wide industrial fields as relatively simple and excellent printing means, and are required to increase the printing speed and print images of higher quality. Conveyance control of a printing medium such as a printing paper sheet in the printing apparatus has very large influence on image quality. If this control is not correctly done, for example, the landing position of ink discharged to the printing medium shifts. This shift leads to stripes and considerably lowers the image quality.

For positioning in conventional printing medium conveyance control, for example, a digital signal converted based on the zero-cross point of a sinusoidal analog signal output from an encoder is used. In conveyance control using such a digital signal, however, it is feared that control especially at the time of conveyance stop could not meet required accuracy.

To meet requirements of higher image quality, a method as described in Japanese Patent Laid-Open No. 8-201111 has been proposed. More specifically, a sinusoidal analog signal output from an encoder is converted into a digital signal by an A/D converter. The digital signal is supplied to a LPF (Low-Pass Filter) to filter out variations in high frequency components in the signal, that is, lower bits, and then supplied to an interpolation circuit.

In the method described in Japanese Patent Laid-Open No. 8-201111, however, when performing printing medium conveyance control at a relatively high speed, that is, when the rate of change in the analog signal is larger than its sampling period, data that is moving-averaged in the LPF largely varies. For this reason, the correctness of data output from the LPF lowers. On the other hand, if the population parameter of data to be moving-averaged is decreased to solve the above problem, noise components included in the data can hardly be filtered out. In this case as well, the correctness of data output from the LPF lowers. It is therefore impossible to implement accurate positioning in control at the time of printing medium conveyance stop.

SUMMARY OF THE INVENTION

Accordingly, the present invention is conceived as a response to the above-described disadvantages of the conventional art.

For example, a printing apparatus and a conveyance control method thereof according to this invention are capable of performing accurate conveyance control without lowering the correctness of data both when conveying a printing medium at a high speed and when performing stop control.

According to one aspect of the present invention, there is provided a printing apparatus. The apparatus comprises: an acquiring unit configured to acquire data generated at a predetermined period in accordance with driving of a conveyance unit configured to convey a printing medium; a first specify unit configured to specify an average value of the data based on a plurality of data acquired by the acquiring unit; a second specify unit configured to specify a conveyance velocity of the printing medium based on the average value of the data specified by the specify unit; a deciding unit configured to decide a number of data, used by the second specify unit, for specifying the average value of the data in accordance with the conveyance velocity specified by the second specify unit; and a control unit configured to control the conveyance unit using the average value of the data specified by the second specify unit as position data of the printing medium.

According to another aspect of the present invention, there is provided a non-transitory computer-readable storage medium storing a program that causes a computer to function as each unit of an apparatus having the above construction.

According to still another aspect of the present invention, there is provided a conveyance control method. The method comprises: acquiring data generated at a predetermined period in accordance with driving of a conveyance unit configured to convey a printing medium; specifying an average value of the data based on a plurality of acquired data; specifying a conveyance velocity of the printing medium based on the specified average value of the data; deciding the number of stages of data used for specifying the average value of the data in accordance with the specified conveyance velocity; controlling the conveyance unit using the specified average value of the data as position data of the printing medium.

The invention is particularly advantageous since accurate conveyance control can be done both at the time of high-speed conveyance and at the time of low-speed conveyance.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" generically means an ink orifice or a liquid channel communicating with it, and an element for generating energy used to discharge ink, unless otherwise specified.

Figure 1:
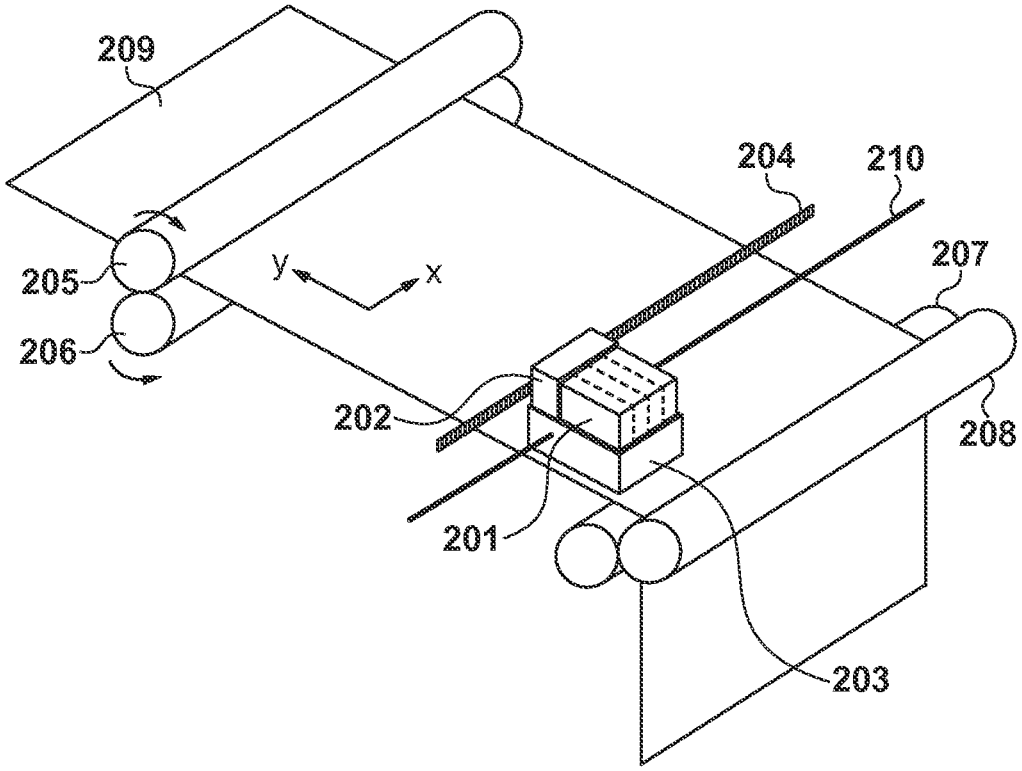
FIG. 1 is a perspective view showing the schematic arrangement of an inkjet printing apparatus according to an exemplary embodiment of the present invention.

FIG. 1 is a perspective view showing the schematic arrangement of, mainly, the printing unit of an inkjet printing apparatus (to be referred to as a printing apparatus hereinafter) according to an exemplary embodiment of the present invention.

Referring to FIG. 1, an ink cartridge 201 individually contains four, black (Bk), cyan (C), magenta (M), and yellow (Y) color inks. The container chambers are integrated. A head cartridge 202 is formed as one printhead having a total of eight printing element arrays, that is, two arrays for each of the color inks contained in the ink cartridge 201. More specifically, two printing element arrays are provided to discharge each of Bk, C, M, and Y inks, and a total of eight printing element arrays corresponding to the four colors are integrated in the head cartridge 202. A carriage 203 to which the ink cartridge 201 and the head cartridge 202 are detachably attached slidably engages with a guide shaft 210 so as to be movable along the guide shaft 210.

An encoder scale 204 provided on a surface facing the carriage 203 has slits at an interval of 150 lpi. An encoder sensor (not shown) irradiates the encoder scale 204 with light, and outputs A- and B-phase signals based on the transmitted light in accordance with the scan position of the carriage 203. The B-phase signal is delayed by 90° from the A-phase signal.

A conveyance roller 205 and an auxiliary roller 206 respectively rotate in the directions of arrows in FIG. 1 while sandwiching a printing paper sheet 209, thereby conveying the printing paper sheet 209 in the y direction (conveyance direction) in FIG. 1. A pair of feed rollers 207 and 208 feed the printing paper sheet 209 while sandwiching it. The conveyance roller is also provided with an encoder (not shown), and the rotation amount (driven amount) of the conveyance roller is detected from the encoder. The moving amount or position of the printing medium in the conveyance direction can be detected (acquired) based on the rotation amount detected from the encoder. In addition, when the conveyance roller rotation amount per unit time is acquired from the encoder, the conveyance velocity of the printing medium can also be acquired.

Figure 2:
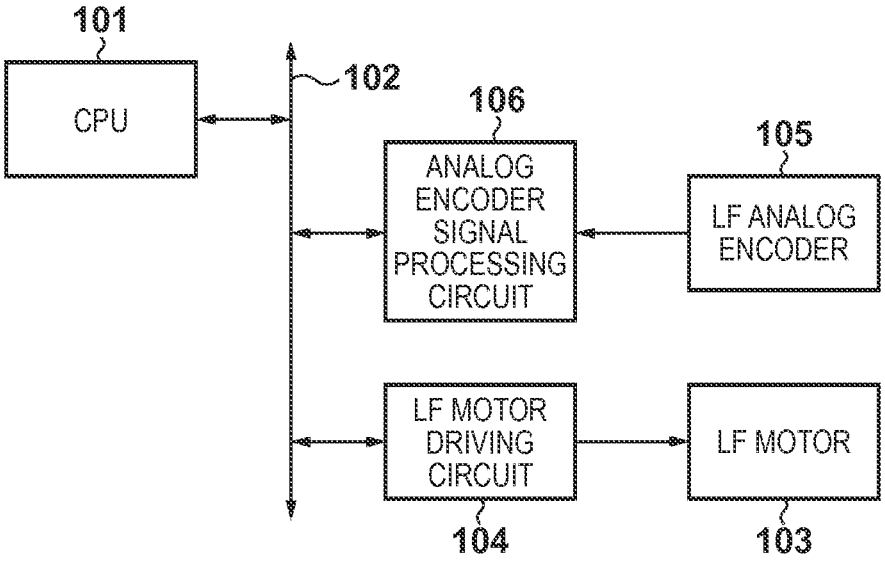
FIG. 2 is a block diagram showing the control arrangement of, mainly, the LF-motor control sub-system of the printing apparatus shown in FIG. 1.

FIG. 2 is a block diagram showing the control arrangement of, mainly, the LF-motor control sub-system of the printing apparatus shown in FIG. 1.

Referring to FIG. 2, a CPU 101 does various settings for an analog encoder signal processing circuit 106 and an LF motor driving circuit 104 (to be described later) via a bus 102. Upon receiving an interruption from the analog encoder signal processing circuit 106 or the LF motor driving circuit 104, the CPU 101 performs appropriate processing.

An LF motor (conveyance motor) 103 is combined with a gear (not shown) and connected to the conveyance roller 205 so as to serve as a power source for conveying a printing medium such as a printing paper sheet. The LF motor driving circuit 104 is formed from a logic IC and a motor driver IC, and drives the LF motor 103. An LF analog encoder 105 is a so-called rotary encoder, and outputs two sine waves having a phase difference of 90° to calculate the conveyance amount and the conveyance velocity of the printing paper sheet 209. The output signal of the LF analog encoder 105 corresponds to the rotation angle (position in the rotation direction) of the conveyance roller 205. The analog encoder signal processing circuit 106 converts a signal input from the LF analog encoder 105 into position data (angle information). Note that the LF analog encoder 105 may detect the rotation angle of the LF motor (conveyance motor) 103.

Several embodiments will be explained next concerning printing medium positioning control in the printing apparatus having the above-described arrangement.

First Embodiment

Figure 3:
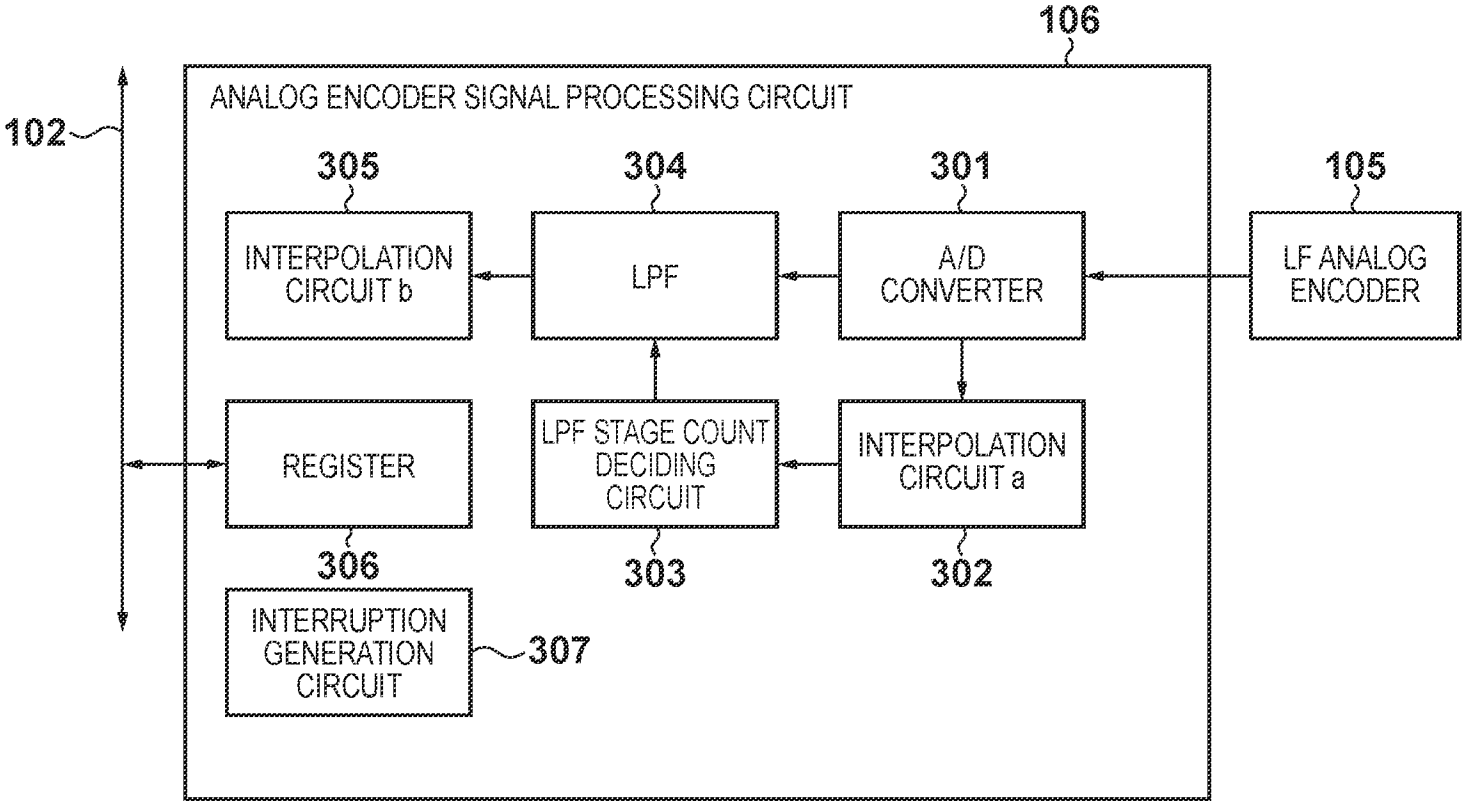
FIG. 3 is a block diagram showing the internal arrangement of an analog encoder signal processing circuit 106 according to the first embodiment.

FIG. 3 is a block diagram showing the internal arrangement of an analog encoder signal processing circuit 106 according to the first embodiment.

An A/D converter 301 converts each of two sinusoidal signals (analog data) input from an LF analog encoder 105 into 10-bit digital data, and outputs the digital data to an interpolation circuit a 302 and an LPF 304.

The interpolation circuit a 302 generates 64 interpolated divided data (position data) from the input digital data. That is, one revolution)(360° of a conveyance roller 205 is assigned to 64 angle regions. The generated position data (angle information) is output to an LPF stage count deciding circuit 303. Interpolated divided data is generated from digital data using, for example, a method of calculating an arctangent or a method of referring to a lookup table (LUT). Any of the methods is usable.

The LPF stage count deciding circuit 303 calculates the conveyance velocity from the history of position data input from the interpolation circuit a 302, and decides the number of stages of the LPF. The decided number of stages is output to the LPF 304. The number of stages of the LPF is decided by combining two conveyance velocity determination methods, that is, a method (count threshold) of making a judgment based on how many times the position data of the same position is continuously input and a method (difference threshold) of making a judgment based on the difference between position data input at that time and preceding input position data. A detailed LPF stage count deciding method by the LPF stage count deciding circuit 303 will be described later.

The LPF 304 filters out higher harmonic components of the input signal and then outputs the filtered signal to an interpolation circuit b 305.

Figure 4:
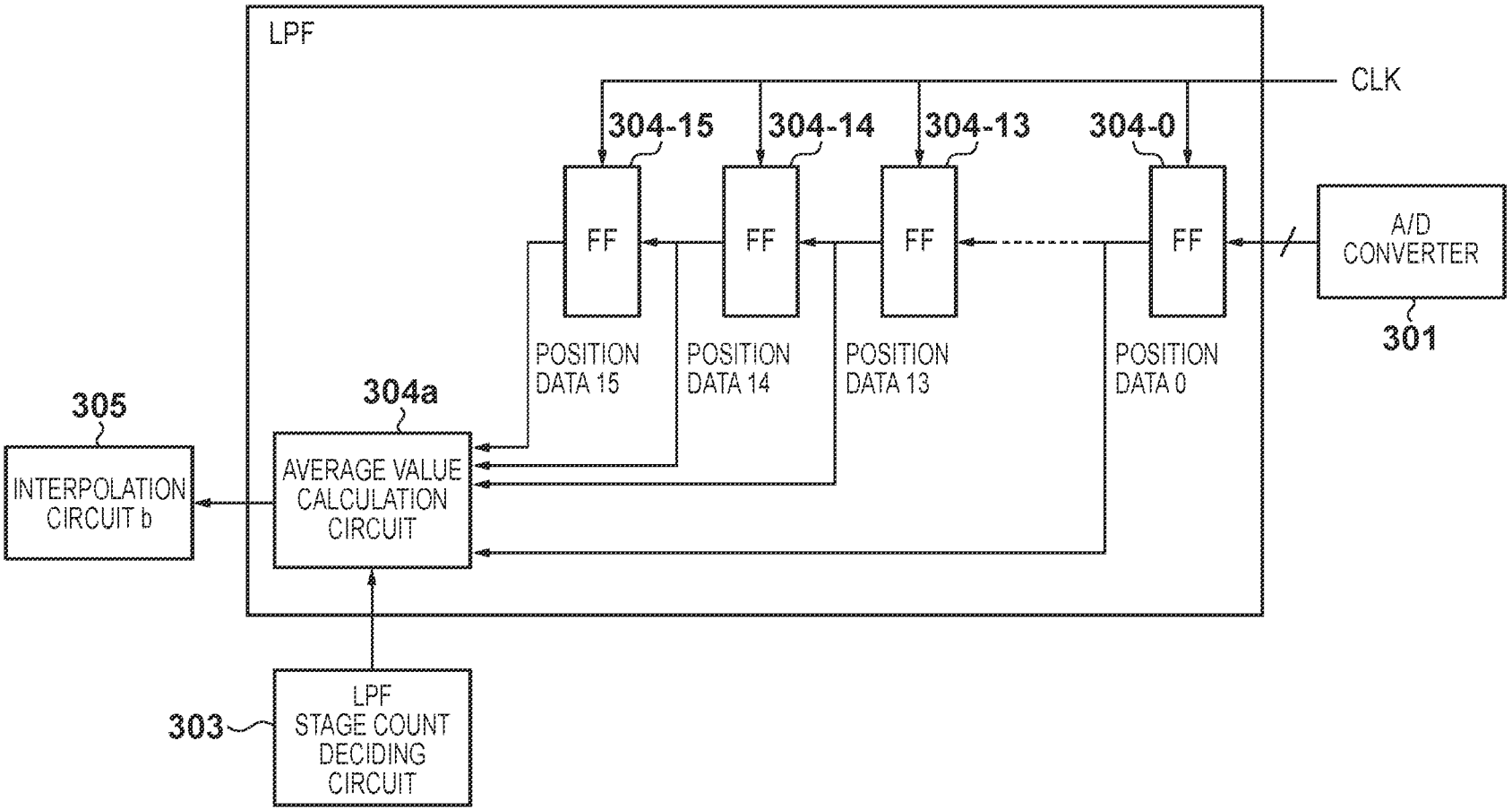
FIG. 4 is a block diagram showing the internal arrangement of an LPF 304.

FIG. 4 is a block diagram showing the internal arrangement of the LPF 304.

The LPF 304 is formed using a moving average method. More specifically, in the LPF 304, position data input from the A/D converter 301 is shifted by a shift register formed from series-connected flip-flop circuits (FF) 304-0 to 304-15 of a plurality of (16) stages in synchronism with a system clock. With this arrangement, position data of 16 different timings are held. All the shifted 16 position data, that is, position data 0 to position data 15 are input to an average value calculation circuit 304*a*. In accordance with the number of stages (defined as n) of the LPF designated by the LPF stage count deciding circuit 303, the average value calculation circuit 304*a* samples position data 0 to position data (n−1), calculates the average value, and outputs the result to the interpolation circuit b 305.

The interpolation circuit b 305 generates 64 interpolated divided data (position data) from the input digital data, like the interpolation circuit a 302. The position data generated by the interpolation circuit b 305 is final position data to be used in printing medium conveyance control.

Referring back to FIG. 3, a register 306 includes a register configured to control the analog encoder signal processing circuit 106, for example, a register configured to set the number of stages of the LPF in each speed range (to be described later) and the set value of position data at which an interruption takes place. The register 306 is controlled by the CPU 101 via the bus 102.

An interruption generation circuit 307 checks whether the position data generated by the interpolation circuit b 305 has reached the set value of position data provided in the register 306. And, the interruption generation circuit 307 generates an interruption signal when it is checked the position data generated by the interpolation circuit b 305 has reached the set value of position data, and outputs the interruption signal to the CPU 101.

A specific example of the detailed LPF stage count deciding method by the LPF stage count deciding circuit 303 according to this embodiment will be described next.

In the following example, the above-described count threshold is set to 2. When position data of the same position is input continuously three or more times, the conveyance velocity is judged to be in the low speed range. When the input count of position data of the same position is 2 or less, the conveyance velocity is judged to be in the intermediate speed range. On the other hand, the difference threshold is set to 2. When the difference between position data input at that time and preceding input position data is 2 or less, the conveyance velocity is judged to be in the intermediate speed range. When the difference is larger than 2, the conveyance velocity is judged to be in the high speed range. The speed range is thus determined.

Upon determining continuously three times that the conveyance velocity is in the same speed range in conveyance velocity determination, the LPF stage count deciding circuit 303 obtains the speed range as the final determination, and instructs the LPF 304 to set the number of stages for the speed range. More specifically, if the low speed range, the intermediate speed range, or the high speed range is judged continuously three times, the LPF 304 is instructed to set the number of stages of the LPF for the low speed range, the intermediate speed range, or the high speed range. In this embodiment, the numbers of stages are 16 for the low speed range, 8 for the intermediate speed range, and 1 for the high speed range. The set values of the number of stages for the low speed range, the number of stages for the intermediate speed range, and the number of stages for the high speed range are provided in the register 306. Note that if the same speed range is not determined continuously three times, the final determination is the same as the speed range of preceding final determination.

Figure 5:
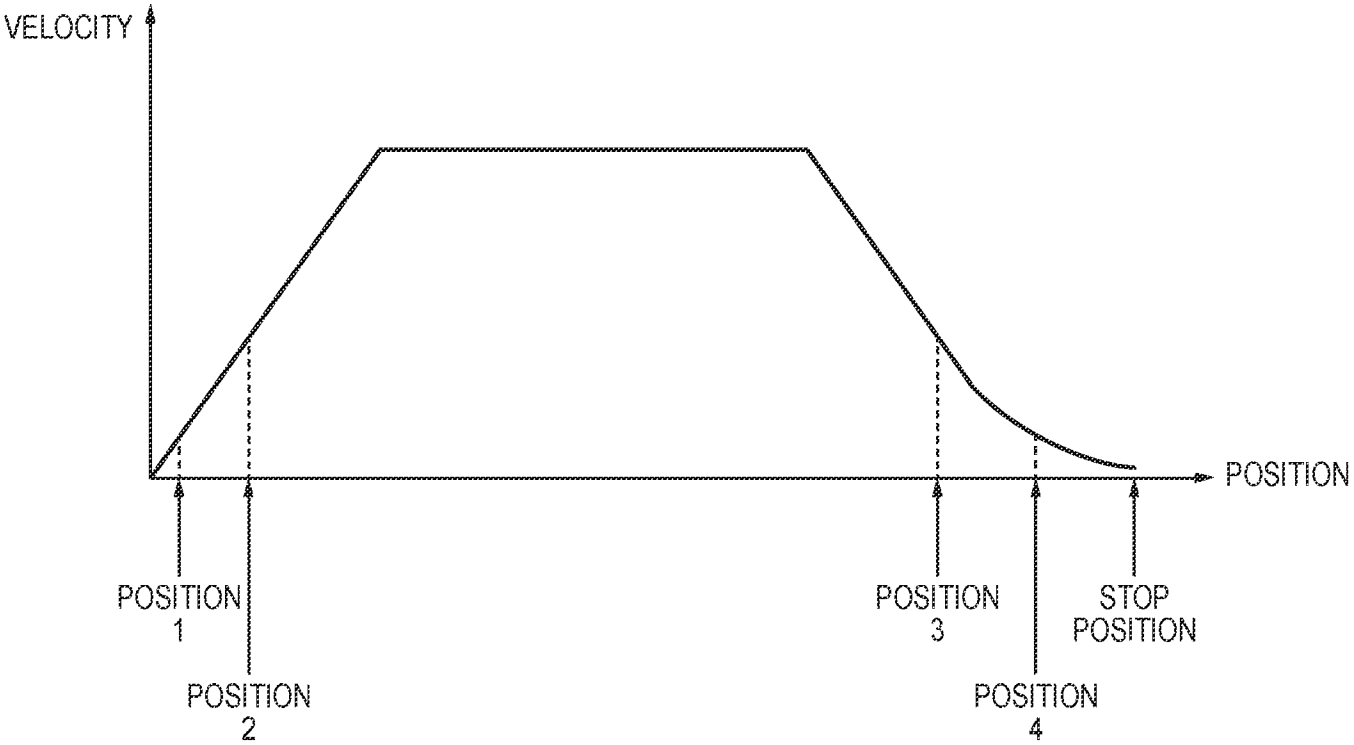
FIG. 5 is a graph showing the relationship between the conveyance position (conveyance distance) and the conveyance velocity of a printing paper sheet according to the first embodiment.

FIG. 5 is a graph showing the relationship between the conveyance position (conveyance distance) and the conveyance velocity of a printing paper sheet.

As shown in FIG. 5, a printing paper sheet is accelerated from a conveyance stop state, continuously conveyed at constant speed for some time when reaching a target velocity, and gradually decelerated toward the conveyance stop position. Conveyance stops at a target position.

Figure 6A:
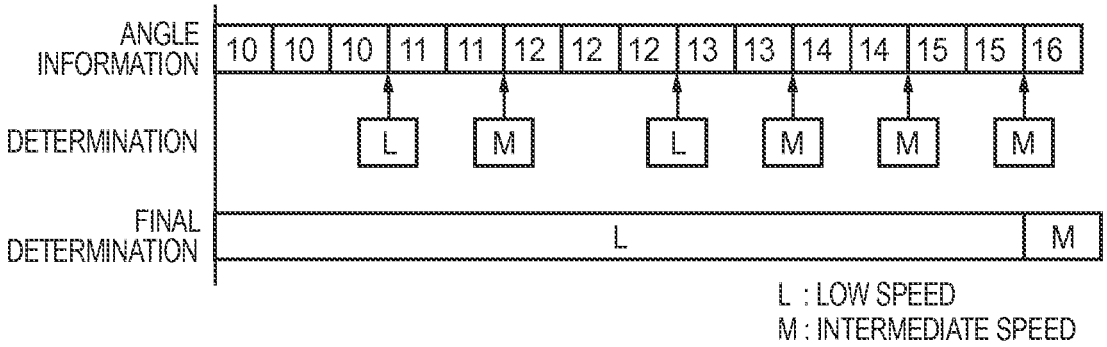
FIGS. 6A, 6B, 6C, and 6D are views showing a process from conveyance velocity determination at positions 1, 2, 3, and 4 shown in FIG. 5 to an instruction to change the number of stages of the LPF.
Figure 6B:
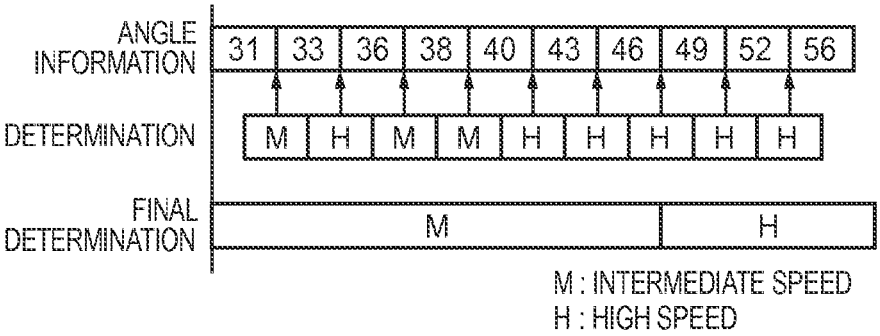
Figure 6C:
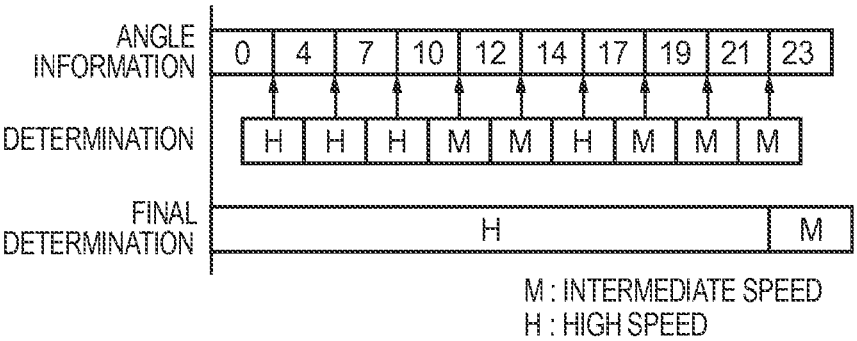
Figure 6D:
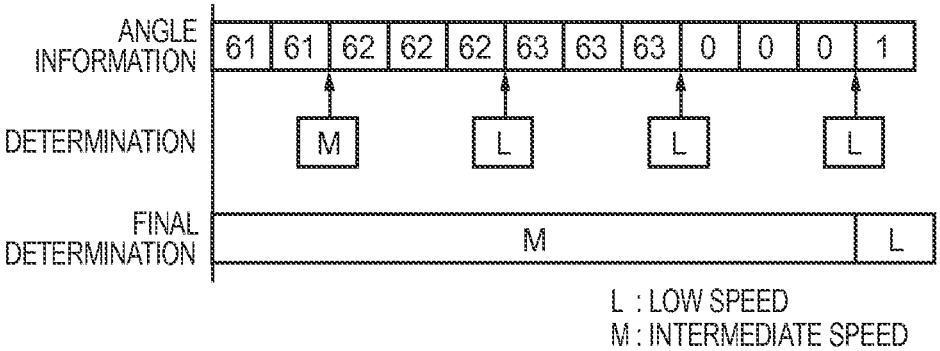

FIGS. 6A to 6D are views showing a process from conveyance velocity determination near positions 1 to 4 in FIG. 5 to an instruction to change the number of stages of the LPF. FIG. 6A shows velocity determination near position 1 shown in FIG. 5. FIG. 6B shows velocity determination near position 2 shown in FIG. 5. FIG. 6C shows velocity determination near position 3 shown in FIG. 5. FIG. 6D shows velocity determination near position 4 shown in FIG. 5.

First, the conveyance velocity is determined as low speed from the start of conveyance to position 1. Hence, the LPF 304 is instructed to set the number of stages of the LPF to 16.

As shown in FIG. 6A, when the value of position data (angle information) is 10, the same value is input continuously three times. Since the count is larger than the count threshold "2", the conveyance velocity is judged as low speed. When the value of position data is 11, the same value is input continuously two times. Since the count is equal to the count threshold "2", the conveyance velocity is judged as intermediate speed. However, since the same speed range is not determined continuously three times, the final determination remains low speed. When the value of position data is 12, the same value is input continuously three times, and the conveyance velocity is similarly judged as low speed. When the values of position data are 13, 14, and 15, the same values are input continuously two times, and the conveyance velocity is judged as intermediate speed. In addition, the intermediate speed is determined continuously three times, the final determination also changes to intermediate speed. The LPF 304 is instructed to set the number of stages of the LPF to 8.

As shown in FIG. 6B, when the value of position data (angle information) changes from 31 to 33, the difference between the position data is 2. Since the difference is equal to the difference threshold "2", the conveyance velocity is judged as intermediate speed. When the value of position data changes from 33 to 36, the difference between the position data is 3. Since the difference is larger than the difference threshold "2", the conveyance velocity is judged as high speed. However, since the same speed range is not determined continuously three times, the final determination remains intermediate speed. Until the value of position data changes from 40 to 56, the difference between the position data is 3 or 4. In any case, the conveyance velocity is judged as high speed. In addition, at the point of time when the position data changes to 49, the conveyance velocity has been judged as high speed continuously three times. Hence, the final determination also changes to high speed. The LPF 304 is instructed to set the number of stages of the LPF to 1.

As shown in FIG. 6C, until the value of position data (angle information) changes from 0 to 10, the difference between the position data is 3 or 4. Since the difference is larger than the difference threshold "2", the conveyance velocity is judged as high speed. When the value of position data changes from 10 to 12, and then from 12 to 14, the difference between the position data is 2. Since the difference is equal to the difference threshold "2", the conveyance velocity is judged as intermediate speed. However, since the value of the next position data is 17, and the difference between the position data is 3, the conveyance velocity is determined as high speed. The same speed range is not determined continuously three times, and the final determination remains high speed. Until the value of position data changes from 17 to 23, the difference between the position data is 2. In any case, the conveyance velocity is judged as intermediate speed. Since the conveyance velocity is judged as intermediate speed continuously three times, the final determination also changes to intermediate speed. Hence, the LPF 304 is instructed to set the number of stages of the LPF to 8.

Finally as shown in FIG. 6D, when the value of position data (angle information) is 61, the same value is input continuously two times. Since the count is equal to the count threshold "2", the conveyance velocity is judged as intermediate speed. When the value of position data is 62, the same value is input continuously three times. Since the count is larger than the count threshold "2", the conveyance velocity is judged as low speed. Similarly, when the values of position data are 63 and 0, the same values are input continuously three times, and the conveyance velocity is judged as low speed. In addition, the low speed is determined continuously three times, the final determination also changes to low speed. The LPF 304 is instructed to set the number of stages of the LPF to 16.

Note that in the above description of FIGS. 6A to 6D, a description of the relationship between the position data and the difference threshold has been omitted for FIGS. 6A and 6D because the difference is smaller than the difference threshold in any case. Similarly, a description of the relationship between the position data and the count threshold has been omitted for FIGS. 6B and 6C because the count is smaller than the count threshold in any case.

Figure 7:
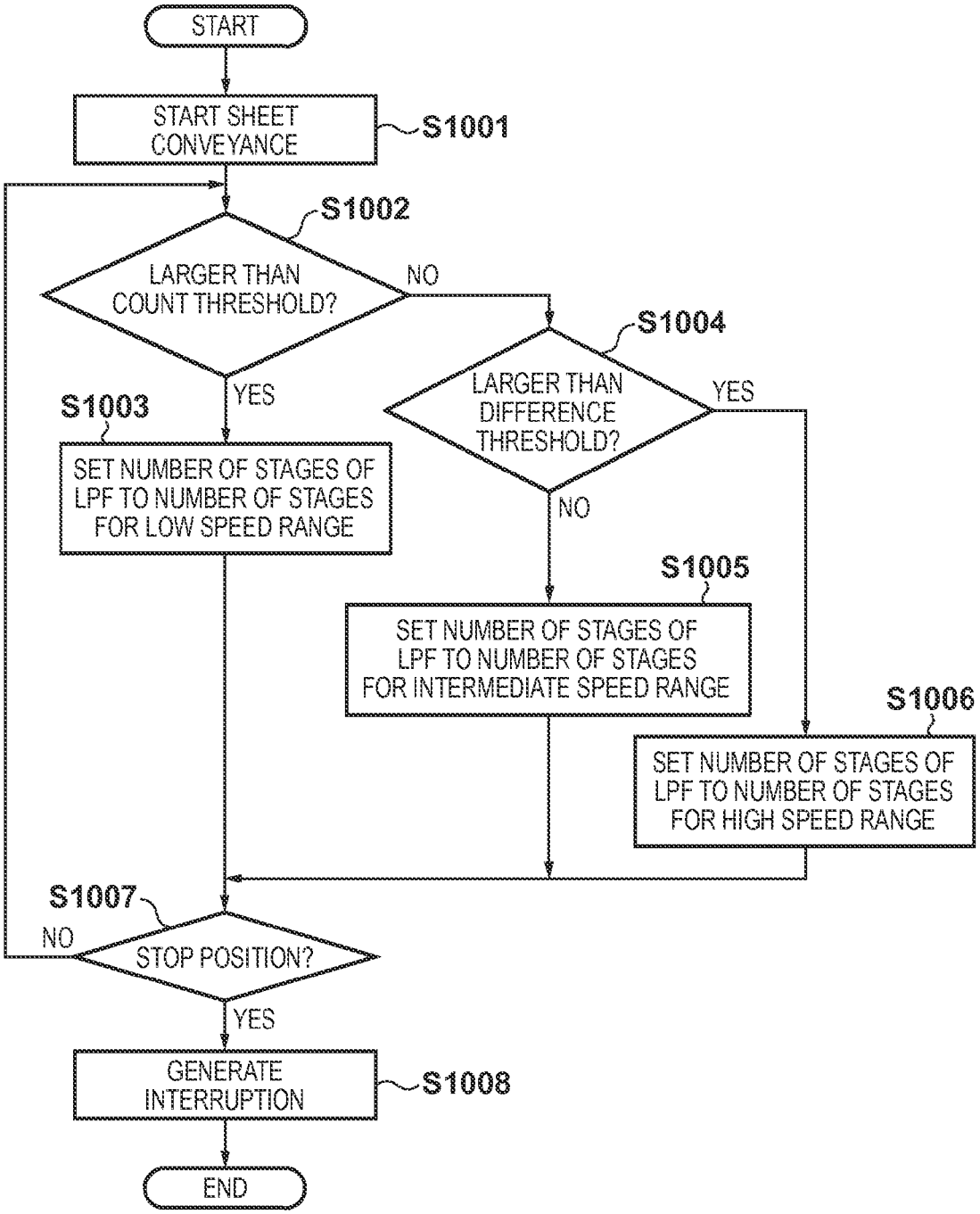
FIG. 7 is a flowchart showing a procedure of deciding the number of stages of the LPF 304 in a period from the start of printing paper sheet conveyance to conveyance stop according to the first embodiment.

FIG. 7 is a flowchart showing a procedure of deciding the number of stages of the LPF 304 in a period from the start of printing paper sheet conveyance to conveyance stop according to the first embodiment.

In step S1001, the CPU 101 controls the LF motor driving circuit 104 to start conveyance of a printing paper sheet. At this point of time, the LPF stage count deciding circuit 303 instructs the LPF 304 to set the number of stages of the LPF to 16. When conveyance starts, the process advances to step S1002.

In step S1002, the LPF stage count deciding circuit 303 checks whether or not the count of continuously inputting the same position data is larger than the count threshold. Upon judging that the count of continuously inputting the same position data is larger than the count threshold, the process advances to step S1003. In step S1003, the LPF stage count deciding circuit 303 instructs the LPF 304 to set the number of stages of the LPF to the number of stages for a low speed range (in this embodiment, 16). After that, the process advances to step S1007.

On the other hand, upon judging that the count of continuously inputting the same position data is not larger than the count threshold, the process advances to step S1004. In step S1004, the LPF stage count deciding circuit 303 checks whether or not the difference between position data input at that time and preceding input position data is larger than the difference threshold.

Upon judging that the difference between position data input at that time and preceding input position data is not larger than the difference threshold, the process advances to step S1005. In step S1005, the LPF stage count deciding circuit 303 instructs the LPF 304 to set the number of stages of the LPF to the number of stages for an intermediate speed range (in this embodiment, 8). After that, the process advances to step S1007. On the other hand, upon judging that the difference between position data input at that time and preceding input position data is larger than the difference threshold, the process advances to step S1006. In step S1006, the LPF stage count deciding circuit 303 instructs the LPF 304 to set the number of stages of the LPF to the number of stages for a high speed range (in this embodiment, 1). After that, the process advances to step S1007.

In step S1007, the interruption generation circuit 307 checks whether or not position data generated by the interpolation circuit b 305 reaches the set value of the position data provided in the register 306, and the printing paper sheet is conveyed up to the stop position. Upon judging that the printing paper sheet is not conveyed up to the stop position, the process returns to step S1002 to continuously perform sheet conveyance control. Upon judging that the printing paper sheet is conveyed up to the stop position, the process advances to step S1008.

In step S1008, the interruption generation circuit 307 generates an interruption signal and outputs it to the CPU 101. The CPU 101 then controls the LF motor driving circuit 104 to stop driving the LF motor and stop conveyance of the printing paper sheet.

Hence, according to the above-described first embodiment, the conveyance velocity of a printing paper sheet is calculated from the displacement amount of position data. The number of stages of the LPF can dynamically be switched over in accordance with the calculated conveyance velocity. This makes it possible to decrease the number of stages of the LPF at the time of high-speed driving of the LF motor and increase the number of stages of the LPF at the time of low-speed driving where stop control is performed.

Second Embodiment

Figure 8:
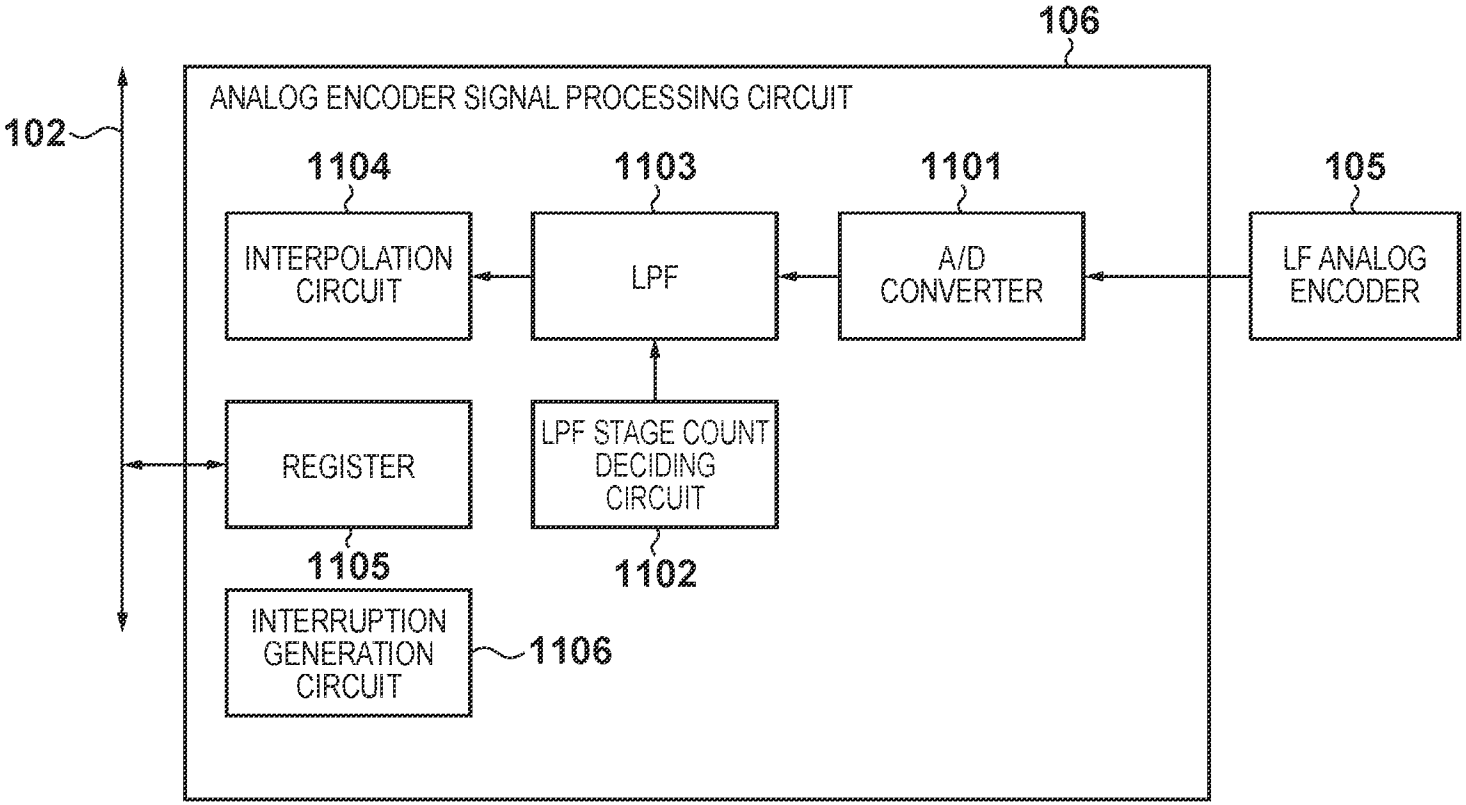
FIG. 8 is a block diagram showing the internal arrangement of an analog encoder signal processing circuit 106 according to the second embodiment.

FIG. 8 is a block diagram showing the internal arrangement of an analog encoder signal processing circuit 106 according to the second embodiment. Note that a description of the same parts as in the first embodiment will be omitted concerning FIG. 8.

An A/D converter 1101 converts each of two sinusoidal signals input from the LF analog encoder 105 into 10-bit digital data, and outputs the digital data to an LPF 1103. An LPF stage count deciding circuit 1102 decides the number of stages of an LPF by referring to a value set in a register 1105. The decided number of stages is output to the LPF 1103. The LPF 1103 filters out higher harmonic components of the input signal and then outputs the filtered signal to an interpolation circuit 1104. The internal arrangement of the LPF 1103 is the same as the LPF 304 already shown in FIG. 4, and a description thereof will be omitted.

The interpolation circuit 1104 generates 64 interpolated divided data (position data) from the input digital data. The position data generated by the interpolation circuit 1104 is final position data to be used in printing paper sheet conveyance control. The register 1105 includes a register configured to control the analog encoder signal processing circuit 106, for example, a register configured to set the number of stages of the LPF 1103 (to be described later) and the set value of position data at which an interruption takes place. The register 1105 is controlled by the CPU 101 via the bus 102. An interruption generation circuit 1106 generates an interruption signal when the position data generated by the interpolation circuit 1104 has reached the set value of position data provided in the register 1105, and outputs the interruption signal to the CPU 101.

A specific example of an LPF stage count deciding method according to this embodiment will be described next. In this embodiment as well, a printing paper sheet in a stop state moves to a stop position via positions 1 to 4 and changes to the stop state again, as shown in FIG. 5 described in association with the first embodiment.

In the stop state, the CPU 101 accesses the register 1105 to set the number of stages of the LPF 1103 to 16. The set value of position data at which an interruption takes place is set such that an interruption takes place upon reaching position 1. Conveyance of a printing paper sheet starts. When the conveyance amount reaches position 1, the interruption generation circuit 1106 outputs an interruption signal to the CPU 101. Upon receiving the interruption signal, the CPU 101 accesses the register 1105 to set the number of stages of the LPF 1103 to 8. At the same time, the set value of position data at which an interruption takes place is set such that an interruption takes place upon reaching position 2.

When the conveyance amount reaches position 2, the interruption generation circuit 1106 outputs an interruption signal to the CPU 101. Upon receiving the interruption signal, the CPU 101 accesses the register 1105 to set the number of stages of the LPF 1103 to 1. At the same time, the set value of position data at which an interruption takes place is set such that an interruption takes place upon reaching position 3. When reaching positions 3 and 4, the same control as described above is performed to set the number of stages of the LPF 1103 to 8 and 16.

Figure 9:
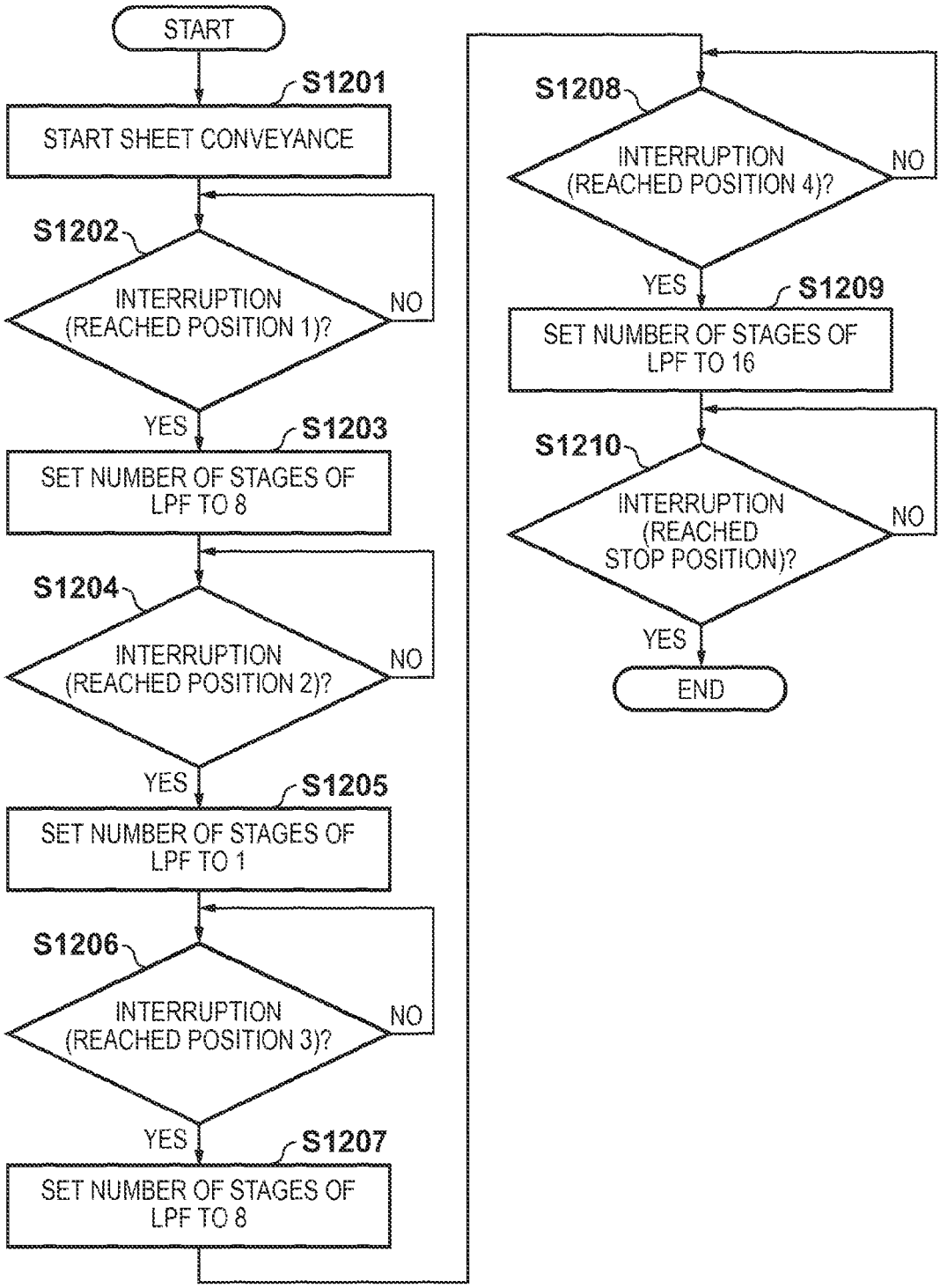
FIG. 9 is a flowchart showing a procedure of deciding the number of stages of an LPF 304 in a period from the start of printing paper sheet conveyance to conveyance stop according to the second embodiment.

FIG. 9 is a flowchart showing a procedure of deciding the number of stages of the LPF 1103 executed by the CPU 101 in a period from the start of printing paper sheet conveyance to conveyance stop according to the second embodiment.

In step S1201, the CPU 101 controls the LF motor driving circuit 104 to start conveyance of a printing paper sheet. At this point of time, the number of stages of the LPF 1103 is set to 16. The set value of position data at which an interruption takes place is set such that an interruption takes place upon reaching position 1. When conveyance starts, the process advances to step S1202.

In step S1202, it is checked whether or not an interruption has taken place upon reaching position 1. If no interruption has taken place because position 1 is not reached yet, the process waits for an interruption in step S1202. If an interruption has taken place upon reaching position 1, the process advances to step S1203. In step S1203, upon receiving an interruption signal, the CPU 101 accesses the register 1105 to set the number of stages of the LPF 1103 to 8. Simultaneously, the set value of position data at which an interruption takes place is set such that an interruption takes place upon reaching position 2. After that, the process advances to step S1204.

In step S1204, it is checked whether or not an interruption has taken place upon reaching position 2. If no interruption has taken place because position 2 is not reached yet, the process waits for an interruption in step S1204. If an interruption has taken place upon reaching position 2, the process advances to step S1205. In step S1205, upon receiving an interruption signal, the CPU 101 accesses the register 1105 to set the number of stages of the LPF 1103 to 1. Simultaneously, the set value of position data at which an interruption takes place is set such that an interruption takes place upon reaching position 3. After that, the process advances to step S1206.

In step S1206, it is checked whether or not an interruption has taken place upon reaching position 3. If no interruption has taken place because position 3 is not reached yet, the process waits for an interruption in step S1206. If an interruption has taken place upon reaching position 3, the process advances to step S1207. In step S1207, upon receiving an interruption signal, the CPU 101 accesses the register 1105 to set the number of stages of the LPF 1103 to 8. Simultaneously, the set value of position data at which an interruption takes place is set such that an interruption takes place upon reaching position 4. After that, the process advances to step S1208.

In step S1208, it is checked whether or not an interruption has taken place upon reaching position 4. If no interruption has taken place because position 4 is not reached yet, the process waits for an interruption in step S1208. If an interruption has taken place upon reaching position 4, the process advances to step S1209. In step S1209, upon receiving an interruption signal, the CPU 101 accesses the register 1105 to set the number of stages of the LPF 1103 to 16. Simultaneously, the set value of position data at which an interruption takes place is set such that an interruption takes place upon reaching the stop position. After that, the process advances to step S1210.

In step S1210, it is checked whether or not an interruption has taken place upon reaching the stop position. If no interruption has taken place because the stop position is not reached yet, the process waits for an interruption in step S1210. If an interruption has taken place upon reaching the stop position, the CPU 101 controls the LF motor driving circuit 104 to stop driving the LF motor and stop conveyance of the printing paper sheet.

Hence, according to the above-described second embodiment, the number of stages of the LPF can dynamically be switched over when a printing paper sheet reaches a predetermined position at which a target velocity is obtained during driving of the LF motor. This makes it possible to decrease the number of stages of the LPF at the time of high-speed driving of the LF motor and increase the number of stages of the LPF at the time of low-speed driving where stop control is performed.

In both embodiments, when the rate of change in position data is large in high-speed conveyance, the number of stages of the LPF is decreased to suppress data variations in the LPF. At the time of low-speed conveyance, the number of stages of the LPF is increased, thereby obtaining more accurate angle information without higher harmonic components. It is therefore possible to implement accurate printing medium conveyance control at any conveyance velocity.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-078983, filed Apr. 4, 2013, which is hereby incorporated by reference herein in its entirety.

What is claimed is:

1. An apparatus comprising:

an input unit configured to input analog data generated in accordance with driving of a conveyance unit configured to convey a printing medium;

a conversion unit configured to convert the analog data input by the input unit into digital data;

a deciding unit configured to specify a conveyance velocity based on the digital data converted by the conversion unit, and decide a number of the digital data used for an averaging operation for specifying an average value of the digital data in accordance with the specified conveyance velocity;

a specify unit configured to specify the average value of the digital data, using the number of the digital data decided by the deciding unit;

a position data generation unit configured to generate position data for specifying a position of the printing medium based on the average value of the digital data specified by the specify unit; and a control unit configured to control the conveyance unit based on the position data generated by the position data generation unit.

2. The apparatus according to claim 1, wherein the specify unit comprises a low-pass filter, the number of the digital data used for the averaging operation is a number of stages of the low-pass filter, and the deciding unit increases a number of stages of the low-pass filter in a case where the specified conveyance velocity is lowered.

3. The apparatus according to claim 2, wherein a plurality of positions indicated by the position data include:

a first position at which the conveyance velocity of the printing medium changes from a low speed range to an intermediate speed range;

a second position at which the conveyance velocity of the printing medium changes from the intermediate speed range to a high speed range;

a third position at which the conveyance velocity of the printing medium changes from the high speed range to the intermediate speed range; and a fourth position at which the conveyance velocity of the printing medium changes from the intermediate speed range to the low speed range, and the deciding unit samples data of the number of stages of a first value at the second position, samples data of the number of stages of a second value larger than the first value at the first position and the third position, and samples data of the number of stages of a third value larger than the second value at the fourth position.

4. The apparatus according to claim 3, further comprising a register configured to set the number of stages of the low-pass filter in each speed range.

5. The apparatus according to claim 1, wherein in the specify unit, flip-flop circuits of a plurality of stages are series-connected, and each stage holds data obtained at a different timing.

6. The apparatus according to claim 1, wherein the deciding unit specifies the conveyance velocity based on a difference between a plurality of the digital data converted by the conversion unit.

7. The apparatus according to claim 1, wherein the control unit includes a CPU, and the apparatus further comprises an interruption unit configured to generate an interruption signal in a case where the position data reaches a set value representing a predetermined position, and output the interruption signal to the CPU.

8. The apparatus according to claim 1, further comprising an interpolation unit configured to interpolate the digital data converted by the conversion unit and generate interpolated divided data, wherein the deciding unit specifies the conveyance velocity of the printing medium based on the interpolated divided data generated by the interpolation unit.

9. The apparatus according to claim 1, wherein the control unit controls to accelerate the printing medium from a stop state, perform conveyance at a constant speed upon reaching a target velocity, gradually decelerate the printing medium toward a conveyance stop position, and stop conveyance at a target position.

10. The apparatus according to claim 1, further comprising a generation unit configured to generate the analog data in accordance with driving of the conveyance unit configured to convey the printing medium.

11. The apparatus according to claim 10, wherein the generation unit comprises an analog encoder, and the analog encoder is provided in the conveyance unit.

12. The apparatus according to claim 1, further comprising the conveyance unit configured to convey the printing medium.

13. The apparatus according to claim 1, further comprising a printhead configured to print on the printing medium.

14. A method comprising:

inputting analog data generated in accordance with driving of a conveyance unit configured to convey a printing medium;

converting the input analog data into digital data;

specifying a conveyance velocity of the printing medium based on the digital data;

deciding a number of the digital data used for an averaging operation for specifying an average value of the digital data in accordance with the specified conveyance velocity;

specifying the average value of the digital data, using the decided number of the digital data;

generating position data for specifying a position of the printing medium based on the specified average value of the digital data; and controlling the conveyance unit based on the generated position data.

15. A non-transitory computer-readable storage medium storing a program that causes a computer to function for:

inputting analog data generated in accordance with driving of a conveyance unit configured to convey a printing medium;

converting the input analog data into digital data;

specifying a conveyance velocity of the printing medium based on the digital data;

deciding a number of the digital data used for an averaging operation for specifying an average value of the digital data in accordance with the specified conveyance velocity;

specifying the average value of the digital data, using the decided number of the digital data;

generating position data for specifying a position of the printing medium based on the specified average value of the digital data; and controlling the conveyance unit based on the generated position data.

* * * * *